United States Patent [19]

Colbert et al.

[11] 4,023,374

[45] May 17, 1977

[54] REPAIR SLEEVE FOR A MARINE PILE AND METHOD OF APPLYING THE SAME

[75] Inventors: Ervin A. Colbert; Richard J. Mann; Robert W. Phillips, all of Centralia, Ill.

[73] Assignee: Symons Corporation, Des Plaines, Ill.

[22] Filed: Nov. 21, 1975

[21] Appl. No.: 634,273

[52] U.S. Cl. ..... 61/54; 52/725; 138/159; 138/162

[51] Int. Cl.[2] ..... E02D 5/60

[58] Field of Search ..... 61/54; 138/159, 160, 138/162, 163, 166, 168; 52/725

[56] References Cited

UNITED STATES PATENTS

| | | | |
|---|---|---|---|
| 724,573 | 4/1903 | Hartung | 61/54 X |
| 2,189,028 | 2/1940 | Hansen | 61/54 X |
| 2,897,553 | 8/1959 | Gorrow | 61/54 X |
| 3,321,924 | 5/1967 | Liddell | 61/54 |
| 3,369,568 | 2/1968 | Davis et al. | 138/168 |
| 3,410,097 | 11/1968 | Young | 61/54 X |
| 3,553,970 | 1/1971 | Wiswell, Jr. | 61/54 |
| 3,631,789 | 1/1972 | Kinsey | 138/163 X |

*Primary Examiner*—Jacob Shapiro
*Attorney, Agent, or Firm*—Norman H. Gerlach

[57] ABSTRACT

A preformed molded fiberglass reinforced plastic repair sleeve for use on a marine or other submerged concrete pile and a method of applying the same. The sleeve is provided with at least one vertical seam consisting of inside interlocking reentrant bends which together establish an interlocking tongue and groove joint. The joint is maintained effective by self-tapping screws which are in engaged relation with steel closure clips or strips. The sleeve after assembly is centered about the pile undergoing repair and the continuous space which exists between the sleeve and the pile is filled with a suitable grout which, when hardened, encompasses the internal or inside portions of the joint under pressure and prevents unfastening of the seam. The vertical longitudinal extent of the sleeve is somewhat greater than the water depth of the partially submerged pile to which it is applied and, where a cylindrical concrete pile is concerned, the sleeve is molded on an arcuate bias so as to present an open gap enabling the sleeve to be readily slipped sidewise onto the pile by one or more divers and the gap thereafter closed in order to effect the interlocked joint. Where a square pile is undergoing repair, the sleeve assumes a conformable four-sided shape or, alternatively, it may be formed of two mating right-angle sleeve sections having a pair of vertical inside interlocking joints or seams between their adjoining side margins.

7 Claims, 10 Drawing Figures

REPAIR SLEEVE FOR A MARINE PILE AND METHOD OF APPLYING THE SAME

The present invention relates to a device and method for use in repairing piling and particularly concrete piling which is designed for marine use and forms the base support for a pier, a wharf, or the like.

Depending upon a wide variety of factors such as the composition and quality of the concrete or other material which is employed for the piling, the chemical constituent of the ambient or surrounding water, seasonal temperature conditions, the structural design of the pier, the likelihood of impact forces arising from arriving and departing ships or other vessels, corrosion, marine attack, and many other factors, many piers have a limited life expectancy. After a period of time, which may last for as long as several years, small cracks or crevices arise in the surface of the concrete and these may gradually increase in size and number, particularly under conditions of freezing and thawing. Stated otherwise, erosion plays a large part in the life expectancy of a concrete pile and, in time, large chunks or particles of the pile may become dislodged so that eventually the pile, and consequently, the pier or other marine structure with which it is used, becomes unsafe. When any given concrete pile reaches an unsafe condition due to any or all of such causes, it is reasonable to assume that the remaining piles which collectively make up the base support for the pier also have deteriorated to a marked degree since all of the piles are subjected to practically the same environmental conditions. Where visible signs of pile deterioration become apparent, it then becomes expedient to resort to either pile replacement or pile repair. Pile repair by a localized grout-patching process is considered impractical since it is impossible to reach relatively deep cracks or crevices and, furthermore, underwater grout patching is virtually an impossibility due to the diffusion of the wet soft grout material below water level. Even when the grout which is employed is thoroughly mixed with an epoxy or other binder material or a pure epoxy resin is employed for localized patching purposes, the local patches do not adhere well and ultimately break loose from their bond.

Alternate equipment and methods of pile repair have been either to utilize a wrap-around sleeve of polypropolene or other waterproof material and to secure the sleeve in place by way of plastic strapping bands which are tensioned about the sleeve at various elevations by the use of a conventional tensioning and band-applying tool, or to place a split full-height metal sleeve around the pile to be repaired and similarly to secure the same in place with the side margins thereof in overlapping relationship by way of steel strapping bands. The disadvantage of such methods obviously resides in the difficulty of manipulating the strapping bands under water, applying the usual or conventional metal seals thereto, and utilizing a hand-operated tensioning tool which must repeatedly be worked back and forth by reason of the fact that it is impractical to operate either an electrical or a pneumatic power-actuated tensioning tool under water. Furthermore, a wrap-around sleeve of plastic or sheet metal material is subject to puncture at points of impact or at points where sharp concrete edges or points protrude from the pile. When such a puncture takes place, the sleeve is worthless since water enters the same and concrete deterioration continues to progress just as though no pile-encompassing sleeve were present. Finally, a sheet metal sleeve with overlapping side margins or seams does not afford a good water seal at the regions in between the tensioned strapping bands and the same condition of water seepage takes place after a period of time so that the repair job is, at best, a temporary one.

The present invention is designed to overcome the above-noted limitations that are attendant upon the construction and use of present-day pile repair equipment and services that are employed for marine piers and the like and, toward this end, the invention contemplates the provision of a novel device and method for repairing a badly deteriorated concrete pier pile, the device consisting of a pre-molded, flexible, fiberglass reinforced sleeve, the longitudinal extent of which is somewhat greater than the depth of the water in the vicinity of the pile which is to be repaired and which in one form of the invention is of arcuate configuration over a major circle sector but which leaves a side opening of adequate width as to enable the sleeve blank to be slipped sidewise over the pile by one or more divers in charge of making the repair installation. The vertical side margins of the arcuate sleeve blank are provided with cooperating interlocking tongue and groove arrangements which, when interlocked, provide a vertical seam or bead of full sleeve height and are disposed on the inside of the sleeve. The diameter of the thus formed sleeve is somewhat greater than that of the pile so that when the sleeve is centered on the pile, an annulus or continuous void is established between the sleeve and the pile. The sleeve, being of greater vertical height than the depth of the water surrounding the pile, projects above the water line so that a suitable grout may be readily poured into such annulus or void from above water line. This grout completely encases the internallydisposed tongue ad groove arrangements or seam and exerts a pressure thereon so that when it has become hardened, it is impossible to open the seam or bead or otherwise dismantle the sleeve. The sleeve installation is thus intended to remain a permanent one and the sleeve-encased pile possesses at least as great, if not greater, strength than the pile in its original condition.

Numerous other advantages accrue from the specific construction and use of such a fiberglass reinforced sleeve for pile repair purposes and these will be described in detail presently when the nature of the invention is better understood. The invention is disclosed and described herein in connection with the repair of a cylindrical marine concrete pile, but there is also in the accompanying drawings a single view disclosure of the manner in which a square or rectangular concrete pile may be repaired according to the present invention, and in this specification a brief description thereof. The same principles and advantages obtain in either instance.

Other objects of the invention and the various advantages thereof will be apparent from a consideration of the following detailed description.

The invention consists in the several novel features which are hereinafter set forth and are more particularly defined by the claims at the conclusion hereof.

In the accompanying three sheets of drawings forming a part of this specification, two illustrative embodiments of the invention are shown.

Figure 1:
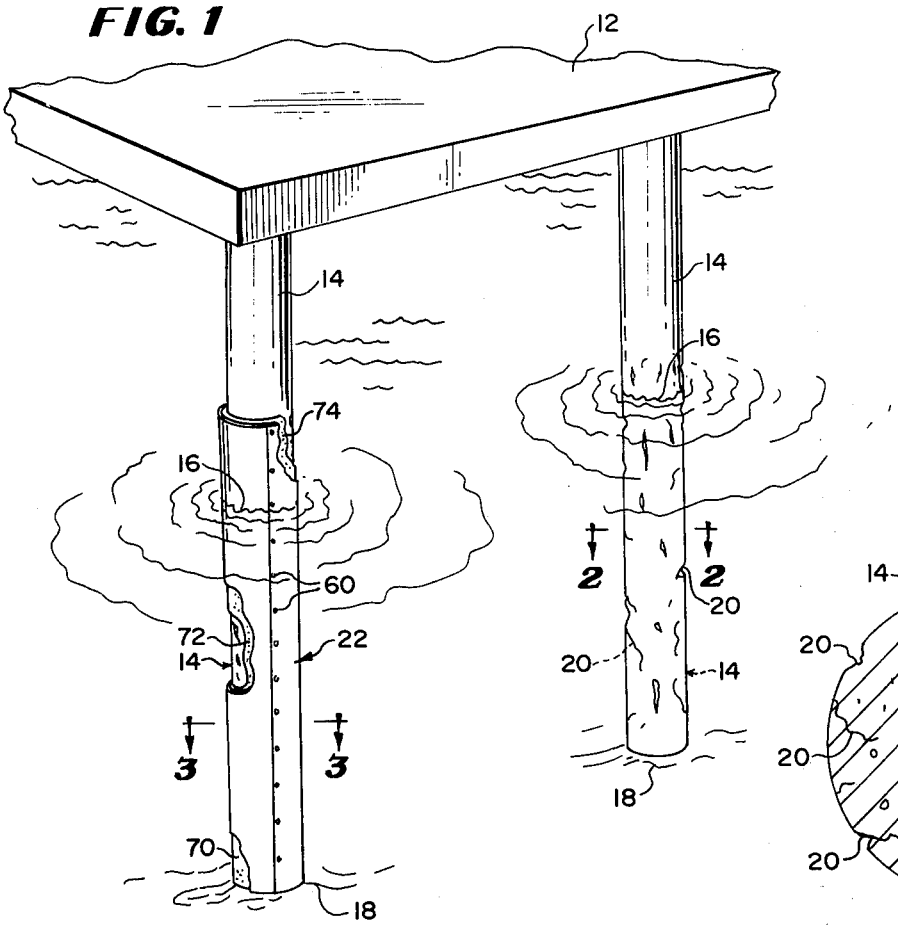
FIG. 1 is a fragmentary perspective view of a marine pier embodying cylindrical concrete piles, one of the piles being shown after it has been repaired by utilization of the device and method of the present invention.
Figure 2:
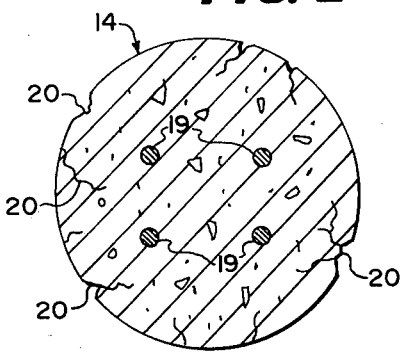
FIG. 2 is an enlarged horizontal sectional view of an unrepaired concrete pile, the view being taken on the line 2—2 of FIG. 1.
Figure 3:
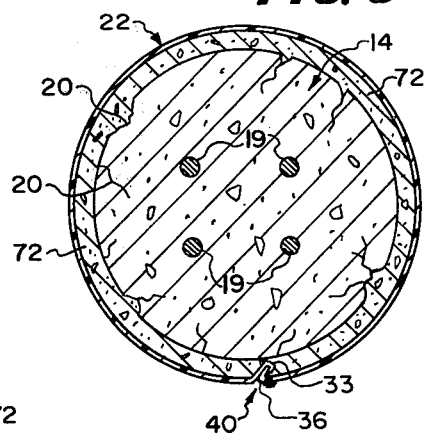
FIG. 3 is an enlarged horizontal sectional view of the repaired concrete pile, the view being taken on the line 3—3 of FIG. 1.
Figure 4:
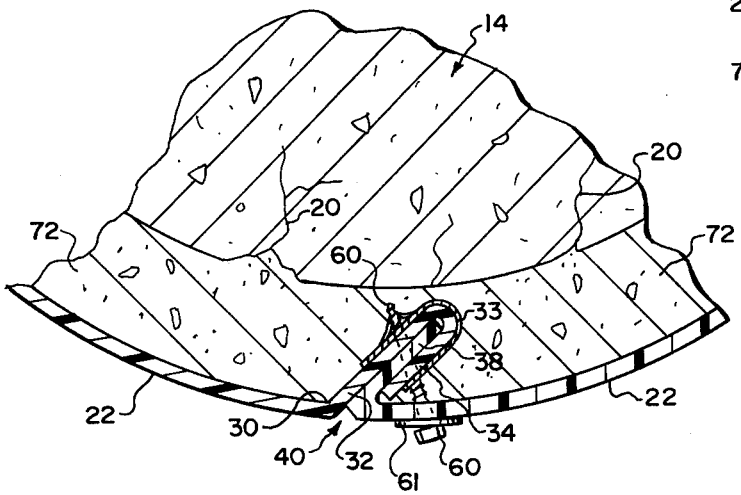
FIG. 4 is a further enlarged horizontal sectional view taken horizontally through a peripheral region of the repaired pile of FIG. 1 and in the vicinity of what is hereinafter referred to as an interlocking Z-bead which is employed in connection with the present invention.

Referring now to the drawings and in particular to FIG. 1, a fragmentary portion of a marine pier is designated in its entirety by the reference numeral 10, the pier embodying a pier platform 12 which is supported by piling in the form of a plurality of upstanding appropriately spaced, cylindrical, concrete piles 14. The latter extend beneath the surface of the body 16 of water and find support on the bottom surface of the lake, river or ocean or other body of water in which the pier 10 is located.

Concrete piling of the type under consideration is subject to deterioration over a period of time, particularly the submerged or underwater portions thereof, such deterioration initially assuming the form of cracks, crevices, small indentations and the like, such, for example, as those which are illustrated in FIGS. 1 to 4, inclusive, of the drawings and are designated by the reference numeral 20. These defects become increasingly or progressively larger both in size and number over a period of time until ultimately a dangerous situation exists necessitating difficult underwater repairs, or, alternatively, replacement of the piles of which the piling of the pier is comprised.

According to the present invention, an extremely effective repair to a thus damaged pile may be effected by encompassing such pile with a fiberglass reinforced sleeve of appreciably larger diameter than that of the pile and then filling the annulus or continuous void which is established between the pile and sleeve with concrete or other suitable grout material, all in a manner that will be described in detail subsequently. After the repair has thus been effected, not only is the strength of the pile in compression, flexion, torsion and otherwise, at least as great as in the case of the pile when in its original condition, but additionally its future life is extended beyond the expected life of the original pile.

Still referring to FIGS. 1 to 4, inclusive, and in particular to FIG. 1, it will be noted that the various defects 20 which ordinarily arise in connection with any given concrete pile 14 occur not only beneath the surface of the water, but also an appreciable distance above the water line, this being the result of a rising and falling of the tide, of waves or splashing of water when boats or ships dock in the vicinity of the pier, or of above-water impacts. Therefore, it is necessary that a repair sleeve which is to be used in connection with any given pile shall be somewhat longer than the highest water line to be expected. Accordingly, such a sleeve 22 extends from the underwater, pier supporting surface 18 upwardly beyond the water line or level for a distance equal to that at least where defects such as those designated by the reference numeral 20 may take place. As previously stated, the grout material which fills the annulus or continuous void that exists between the sleeve 22 and the pile 14 is poured into the annulus or void through the open upper rim of the sleeve 14 from top to bottom and completely fills such annulus or void. However, as will be described in detail presently, such grout material is not necessarily of uniform content, the top and bottom portions thereof being preferably in the nature of an epoxy resin, while the medial region thereof is preferably in the form of conventional concrete grout.

Figure 5:
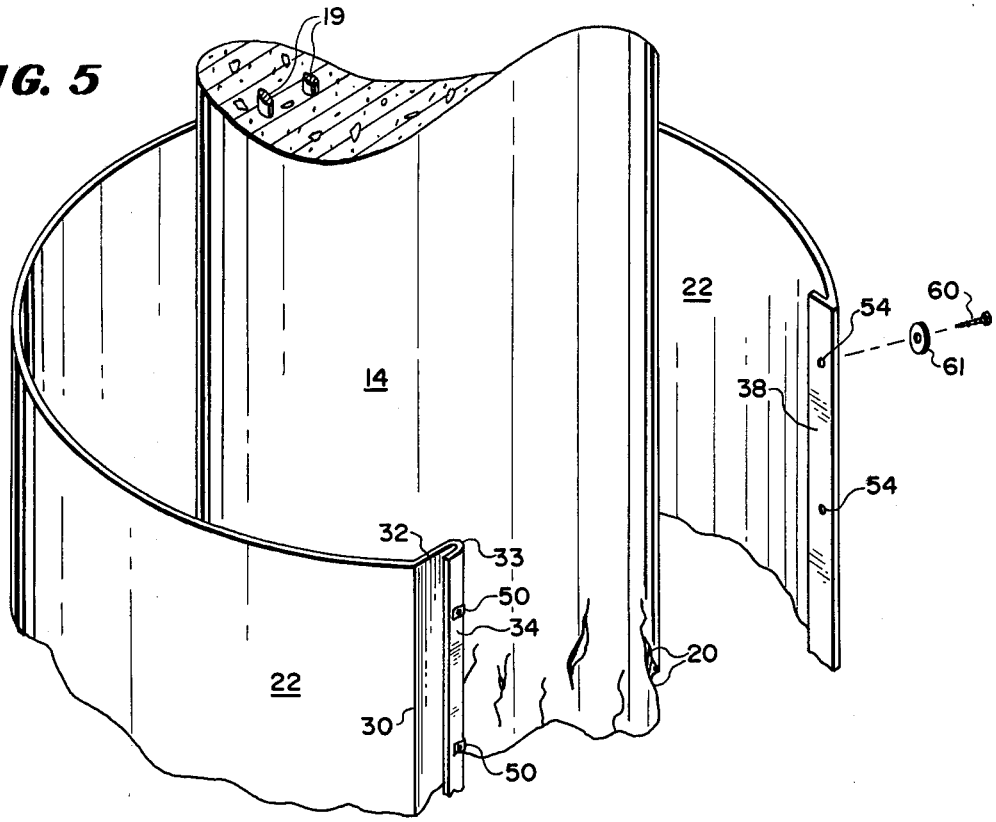
FIG. 5 is an enlarged fragmentary perspective view illustrating the manner in which a pile repair sleeve blank is applied to the pile undergoing repair preparatory to establishing the Z-bead and preparatory to subsequent grout-pouring operations.
Figure 6:
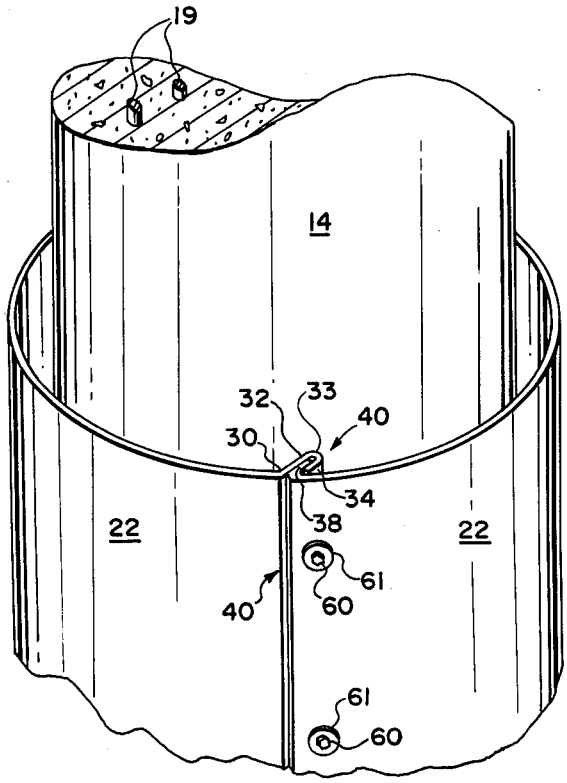
FIG. 6 is a perspective view similar to FIG. 5 but showing the Z-bead completed but preparatory to grout-pouring operations.

Referring now additionally to FIGS. 5 and 6 of the drawings, the repair sleeve 22 is constructed of fiberglass-type reinforced plastic materials which are commercially available from various manufacturers, as, for example, Owens-Corning Fiberglass Company of Toledo, Ohio, and which may be of the type which is furnished, either for original or repair work, in connection with the manufacture of small marine craft, automobile bodies, and the like. In the manufacture of the sleeve 22, a pier repair sleeve is molded or otherwise constructed so as to have a curved bias such as is illustrated in FIG. 5 so that it is arcuate in cross section and has an extent on the order of approximately 270°, thus leaving a gap between its vertical or side edges which is sufficiently wide as to permit an underwater diver readily to pass the open sleeve sidewise over the pile 14 and center the same axially thereon. By thus constructing the sleeve in arcuate or curved form, a number of such sleeves may conveniently be stacked for conservation of space during shipping, handling, or storage.

As clearly shown in FIGS. 5 to 9, inclusive, one vertical edge region of the sleeve 22 is formed throughout its length with an approximate 120° bend 30 thereby resulting in an inturned flange 32, and the outer edge of such flange is formed with a reentrant band 33 thereby providing an out-turned flange 34, the two flanges 32 and 34 being spaced apart and constituting a hook-like portion. The other vertical edge region of the sleeve 22 is formed with an approximate 60° inturned bend 36 thereby resulting in an inturned flange 38 which is received between the flanges 32 and 34 and thus interlocks with the aforementioned hook-like portion to provide a vertical seam or bead 40 when the sleeve 22 is closed or assembled about the associated pile 14.

Figure 7:
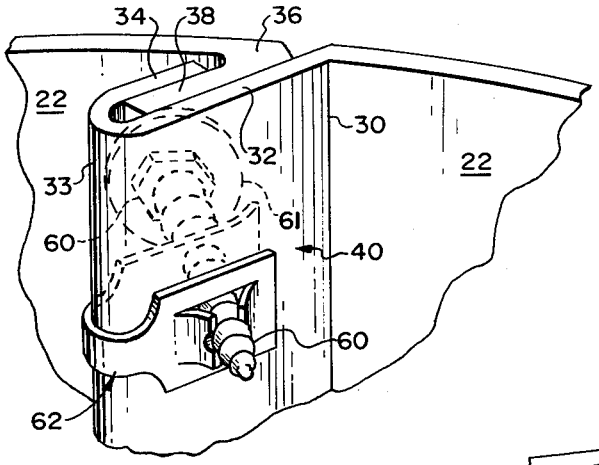
FIG. 7 is a greatly enlarged inside fragmentary perspective view of a limited portion of the Z-bead, the view taken in the vicinity of one of a series of fastening means which are employed for securing in place the parts or components of the Z-bead.
Figure 8:
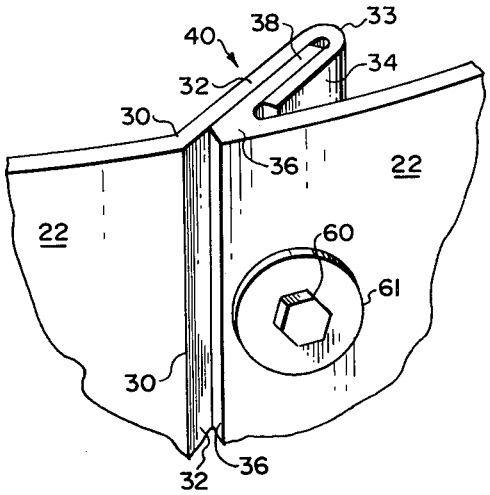
FIG. 8 is an outside perspective view of the structure which is shown in FIG. 7.
Figure 9:
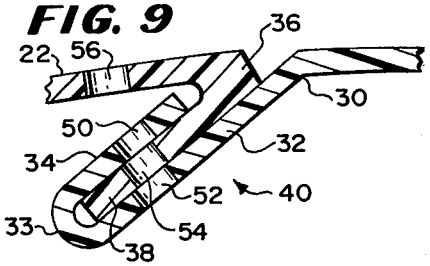
FIG. 9 is a sectional view taken on the horizontal plane indicated by the line 9—9 of FIG. 7 and in the direction of the arrows.

As best shown in FIGS. 5 and 9 of the drawings, in the formation of the reinforced fiberglass sheet from which the sleeve 22 is constructed, a series of vertically spaced pairs of aligned or opposed screw-receiving holes 50 and 52 is formed in the flanges 34 and 32 which are established by the reentrant bend 33. Similarly, pairs of opposed screw-receiving holes 54 and 56 are disposed at similar elevations in the flange 38 and the body of the sleeve 22 so that when the interlock which is formed as shown in FIG. 7 is effected, sheet metal fastening screws 60 of the self-tapping, stainless steel type may be passed through all of the aligned holes 50, 52, 54 and 56. The screws 60 have suitable washers 61 associated therewith in order to increase the effective area of their heads.

The various holes 50, 52, 54 and 56 are of such diameter as freely to allow passage of the sheet metal fastening screws 60 therethough and each such screw has associated therewith a conventional U-shaped closure clip 62 which straddles the reentrant bend 33 and its associated flanges 32 and 34 as clearly shown in FIG. 7. Thus, when each screw 60 is tightened, the seam or bead 40 (which will hereinafter be referred to as a "Z-bead") will become securely locked against dislodgment.

It will be understood, of course, that, as previously indicated, initial installation of the open arcuate fiberglass reinforced sleeve 22 will ordinarily be performed by divers working largely under water. The design of the arcuate sleeve 22 with its various hook-like bends, flanges and the like, as well as its pre-drilled holes, is such that very little difficulty is offered to a diver either in locating the pile with the open sleeve 22, in encompassing the pile with the sleeve, in interlocking the Z-bead 40 to close the sleeve and bring it to its truly cylindrical form, and in centering the closed sleeve 22 coaxially about the pile.

After the protective repair sleeve 22 has been thus centered about the pile 14 to be repaired, the annulus or continuous void which exists between the sleeve and the pile 14 will then be filled with a suitable grout material which will vary according to different installations. Under certain circumstances, the entire annulus or void may be filled with a suitable epoxy grout which consists of an epoxy binder and a sand filler, the compound being machine mixed according to the manufacturer's specifications so that it is compatible with wet surfaces and will adhere to concrete, steel, and fiberglass. Under other circumstances, especially with a pile of considerable height and with large depths of water, approximately 6 inches of such an epoxy grout 70 may be used to fill the lower region of the annulus or void as shown in FIG. 1. After such grout has become set or hardened, the annulus or void may be filled to within approximately 6 inches from the upper rim of the sleeve 22 with a good grade of Portland cement grout 72, after which the remainder of the annulus or void may be filled with epoxy grout 74. Irrespective, however, of the particular grout material or materials which are employed within the annulus or void, the essential features of the invention remain substantially the same.

It is to be noted at this point that since the upper rim of installed sleeve 22 is disposed above the water level, grout-pouring operations for filling the annulus or void which exists between the pile 14 and the sleeve 22 are facilitated. More importantly, it is to be observed that after grout-pouring operations have been completed and the grout material has hardened, the outward thrust of the poured grout is such that the Z-bead 40 is indestructible and cannot be taken apart or the sleeve 22 otherwise opened. This is because the internal reentrant bend 33 (see FIG. 7) and its associated flanges 32 and 34 are encased in the hardened grout. The sleeve installation is, therefore, intended to remain as a permanent one, and toward this end, the molding of the sleeve 22 is such as to leave a relatively rough interior surface which readily bonds with the grout, while the exterior weather surface of the sleeve is sprayed with a suitable chemically-resistant gelcoat which to all intents and purposes is of exceedingly long life.

Figure 10:
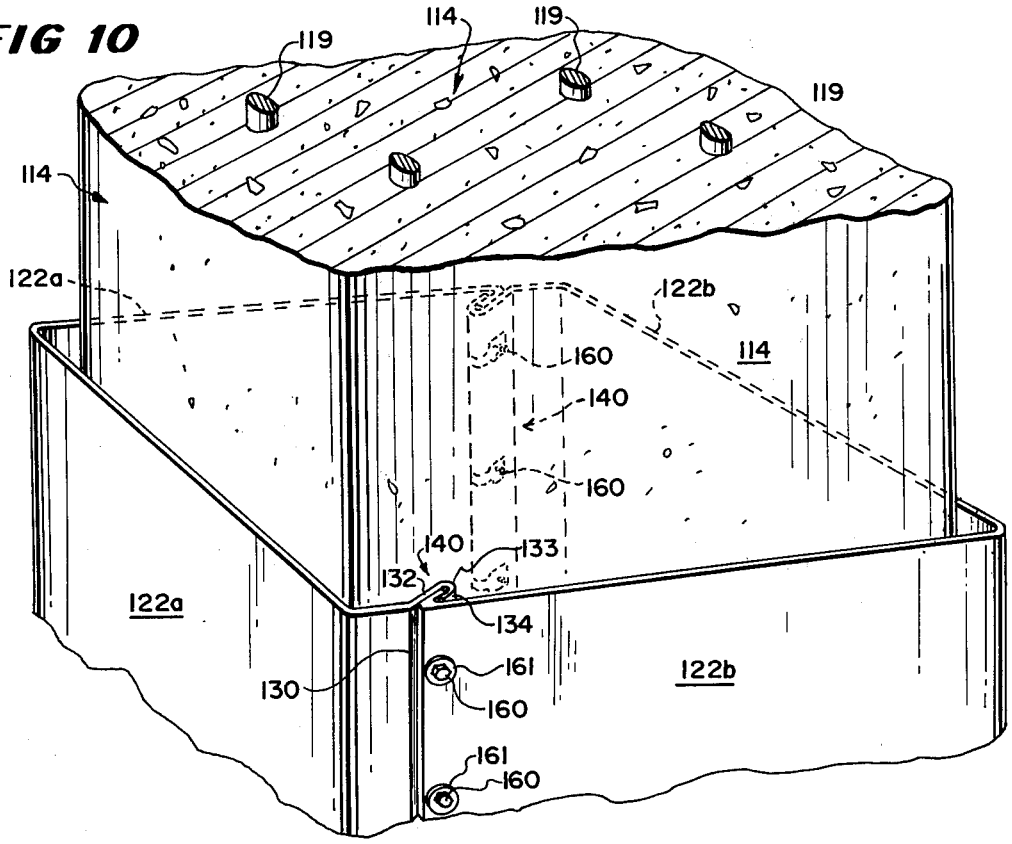
FIG. 10 is a perspective view similar to FIG. 6 but showing a modified form of pile repair sleeve which is employed in connection with the repair of a concrete pile of rectangular cross section.

The invention is readily applicable to a concrete pile which is non-cylindrical, as, for example, the pile 114 which is illustrated in FIG. 10 of the drawings and is rectangular in cross section. Under such circumstances, the conditions which necessitate pile repair remain substantially the same as those which obtain in connection with a cylindrical or round concrete pile but the repair is effected by utilizing a composite sleeve consisting of two similar but complemental right-angle fiberglass reinforced sleeve sections **122*a* and 122*b* having a pair of interlocking Z-beads or seams 140 which are similar to the previously described Z-bead or seam 40 and assume diagonally opposed positions when the sleeve sections 122*a* and 122*b* are interlocked. In molding the two sleeve sections 122*a* and 122*b*, such sections may be fashioned of precise right-angle construction since it is not necessary to spread the sections beyond their 90° angularity when making a repair installation. Due to the similarity between the sleeve Z-beads or seams 140 and the previously described Z-bead or seam 40, and in order to avoid needless repetition of description, similar reference numerals but of a higher order have been applied to the corresponding parts as between the disclosures of FIG. 10 on the one hand and FIG. 6** on the other.

Assembly of the right angular sleeve sections **122*a* and 122*b* in centered relationship with respect to the rectangular pile 114 may be accomplished by one or two divers by the simple expedient of bringing the two sections together in edge-to-edge relationship and in surrounding relation with the pile 114, then snapping the reentrant portions of the two Z-beads 140 together in the manner previously described in connection with the single Z-bead 40, then shifting the assembled composite sleeve to a centered position, and finally filling the continuous void which exists between the sleeve and the pile 114 with an appropriate grout material. As in the case of the cylindrical pile 14, the pressure of the hardened grout prevents unfastening or opening of the Z-beads or seams 140**.

The invention is not to be limited to the exact arrangement of parts shown in the accompanying drawings or described in this specification as various changes in the details of construction may be resorted to without departing from the sprirt or scope of the invention. For example, although the Z-beads 40 and 140 are illustrated and described herein as extending generally at a 60° angle with respect to the adjacent portions of the associated sleeves, it is contemplated that other angles (for example, 45°) may be employed if desired. Therefore, only insofar as the invention is particularly pointed out in the accompanying claims is the same to be limited.

Having thus described the invention what we claim as new and desire to secure by letters patent is:

1. The method of reinforcing a vertical column-like concrete pile which, in association with similar piles, serves to support the platform of a marine pier or the like, said method comprising fashioning an open-ended, tubular repair sleeve which is conformable in outline to the peripheral contour of the pile, the longitudinal extent of which is somewhat greater than the depth of water surrounding the pile, and which has at least one pair of side edges that are formed with normally spaced reentrant bends establishing reentrant flanges which are capable of being brought together in interlocking relationship, causing said repair sleeve to encompass the pile while supported on the pier foundation in centered relationship with the pile so as to project above the normal water line, interlocking said reentrant flanges to close the sleeve and establish a narrow continuous void around the pile, and pouring a semi-liquid grout material into said void from above the water line so as to fill the void, whereby, upon hardening of such grout material, the strength of the hardened grout material will secure said interlocked reentrant flanges against dislodgment.

2. The method of reinforcing a concrete pile as set forth in claim 1 wherein fastening screws are passed through aligned openings in the sleeve and interlocked reentrant flanges so that the grout material is poured into the void at least partially encompasses said fastening screws and prevents their removal after such grout material has become hardened.

3. The method of reinforcing a concrete pile as set forth in claim 2 and wherein the concrete pile is rectangular in cross section, the repair sleeve is of a composite two-piece construction and consists of a pair of similar right-angle fiberglass-reinforced molded sections which, when brought together in edge-to-edge relationship, establish said narrow annulus, and interlocking reentrant flanges are formed on each pair of opposed edges of said sections.

4. The combination with a vertical column-like concrete pile which, in association with a plurality of similar piles, serves to support the platform of a marine pier or the like, of an open-ended tubular repair sleeve encompassing said pile and extending upwardly from the extreme lower end region of the pile to a region above the level of the water around the pier, said repair sleeve embodying a sheet of imperforate, flexible, water-impervious material molded in the form of a major circle sector in which the gap between the vertical edges thereof is of sufficient width so as to permit passage of the sleeve around the pile during installation of the sleeve, one vertical edge of said sheet being provided with an inwardly extending acute angular reentrant bend on the order of 45°, and the other vertical edge of the sheet being formed with an inwardly extending hook-shaped bend which encompasses said reentrant bend so that the two bends establish cooperating interlocking flanges which lie wholly within the tubular confines of the sleeve, said sleeve conforming in circumferential configuration to that of the pile and being centered therearound so as to establish a relatively narrow continuous void around the pile, a hardened grout material filling said void and encompassing said internally disposed interlocking flanges and serving to maintain them in their interlocking relationship against displacement, a vertical series of spaced apart closure clips of U-shape configuration arranged in straddled relation with said interlocking flanges, and a vertical series of spaced apart sheet metal fastening screws projecting through vertical series of registering holes in said interlocking flanges of the reentrant bend and in the legs of the closure clips and making threaded engagement with the latter, said fastening screws being provided with enlarged heads exteriorly of the sleeve and having shank portions which, at least in part, are encased in the hardened grout material within the void.

5. The combination set forth in claim 4 and wherein the sleeve is formed of fiberglass reinforced plastic material, the hardened grout material in the extreme lower region of the void is comprised of an expoxy grout, the hardened grout material in the upper region of said void is comprised of an epoxy grout, and the hardened grout material which is disposed in the medial region of the void between said upper and lower regions is comprised of concrete grout.

6. The combination set forth in claim 5 and wherein the convex side of the sheet of fiberglass-reinforced plastic material which constitutes the outer side of the sleeve is coated with a chemically-resistant gelcoat.

7. The combination with a vertical column-like concrete pile which, in association with a plurality of similar piles, serves to support the platform of a marine pier or the like, of an open-ended tubular repair sleeve encompassing said pile and extending upwardly from the extreme lower end region of the pile to a region above the level of the water around the pier, said repair sleeve embodying a sheet of imperforate, flexible, water-impervious material molded in the form of a major circle sectorin which the gap between the vertical edges thereof is of sufficient width as to permit passage of the sleeve around the pile during installation of the sleeve, one vertical edge of said sheet being provided with an inwardly extending acute angle reentrant bend, and the other vertical edge of the sheet being formed with an inwardly extending hook-shaped bend which encompasses said reentrant bend so that the two bends establish cooperating interlocking flanges which lie wholly within the tubular confines of the sleeve, said sleeve conforming in circumferential configuration to that of the pile and being centered therearound so as to establish a relatively narrow continuous void around the pile, and a hardened grout material filling said void and encompassing said internally disposed interlocking flanges and serving to maintain them in their interlocking relationship against displacement, the hardened grout material in the extreme upper and lower regions of said void being comprised of an epoxy grout and the hardened grout material in the medial regions of the void being comprised of a concrete grout.

* * * * *